US005582164A

United States Patent [19]

Sanders

[11] Patent Number: 5,582,164

[45] Date of Patent: Dec. 10, 1996

[54] CASSETTE SIZE, PRESSURIZED $O_2$ COIL STRUCTURE

[75] Inventor: Stan A. Sanders, 420 29th St., Hermosa Beach, Calif. 90530

[73] Assignees: Stan A. Sanders; William F. Meistrell, both of Rancho Palos Verdes, Calif.

[21] Appl. No.: 560,709

[22] Filed: Nov. 20, 1995

Related U.S. Application Data

[63] Continuation-in-part of Ser. No. 404,272, Mar. 14, 1995, Pat. No. 5,517,984.

[51] Int. Cl.[6] ..... A62B 7/02

[52] U.S. Cl. ..... 128/205.22; 128/207.18; 128/202.19

[58] Field of Search ..... 128/205.22, 207.18, 128/201.27, 202.14, 202.19, 202.26, 205.12, 205.28, 204.15

[56] References Cited

U.S. PATENT DOCUMENTS

| | | | |
|---|---|---|---|
| 771,801 | 10/1904 | Andrew . | |
| 789,145 | 5/1905 | Derx . | |
| 2,380,372 | 7/1945 | Alderfer . | |
| 2,982,105 | 5/1961 | Akers . | |
| 3,064,448 | 11/1962 | Whittington | 128/201.29 |
| 3,491,752 | 1/1970 | Cowley . | |
| 3,837,337 | 9/1974 | LaViolette . | |
| 4,090,509 | 5/1978 | Smith . | |
| 4,253,454 | 3/1981 | Warncke | 128/202.26 |
| 4,685,456 | 4/1987 | Smart | 128/205.22 |
| 4,932,403 | 6/1990 | Scholley | 128/205.22 |
| 4,964,405 | 10/1990 | Arnoth | 128/205.17 |
| 5,036,845 | 8/1991 | Scholley | 128/205.22 |
| 5,127,399 | 7/1992 | Scholley | 128/205.22 |
| 5,234,416 | 8/1993 | Macaulay et al. | 604/282 |
| 5,421,326 | 6/1995 | Rankin et al. | 128/201.19 |

FOREIGN PATENT DOCUMENTS 4007274 12/1991 Germany .

*Primary Examiner*—V. Millin
*Assistant Examiner*—William J. Deane, Jr.
*Attorney, Agent, or Firm*—William W. Haefliger

[57] ABSTRACT

A portable pressurized gas assembly which comprises a first panel structure; first looping pipe coil structure carried by the panel structure in overlying relation to the structure and having flexible construction, there being structure rigidly attaching the pipe coil structure to the panel structure at one side thereof; the looping coil structure having pressurized gas inlet and outlet fittings associated therewith, whereby the looping pipe coil structure may receive pressurized gas for transport by a user; the panel structure and pipe coil structure having an overall length dimension less than about 12 inches and overall width dimension less than about 9 inches.

9 Claims, 2 Drawing Sheets

CASSETTE SIZE, PRESSURIZED $O_2$ COIL STRUCTURE

BACKGROUND OF THE INVENTION

This application is a continuation-in-part of prior U.S. application Ser. No. 08/404,272 filed Mar. 14, 1995 now U.S. Pat. No. 5,517,984.

This invention relates generally to human transport of pressurized gas, and more particularly to an easily concealed structure incorporating pipe coil means that contains pressurized gas, such as oxygen, and wherein the pipe coil is generally conformable to a cassette size package to which such gas is supplied.

There is need for improvements in apparatus to supply gas, such as oxygen, to a human patient needing such supply. Known apparatus comprises a large size oxygen tank, which is bulky and difficult to transport and wear, as for example strapped to the patient's back. Thus, there is need for oxygen supply apparatus which is not bulky, and can be easily concealed, as in a purse carried by the user.

To my knowledge, no prior gas supply apparatus incorporated the unusually advantageous features of construction and operation, and produced the highly desirable results, as are now afforded by the present invention.

SUMMARY OF THE INVENTION

It is a major object of the invention to provide improved apparatus meeting the needs, as referred to above. Basically, the improved, portable pressurized gas assembly provided by the invention is and characterized by:

a) a first panel structure, b) first looping pipe coil means carried by the panel structure in overlying relation to the structure and having flexible construction, there being means rigidly attaching the pipe coil means to the panel structure at one side thereof, c) the looping coil means having pressurized gas inlet and outlet fittings associated therewith, whereby the looping pipe coil means may receive pressurized gas for transport by a user, d) the panel structure and pipe coil means having an overall length dimension less than about 12 inches and overall width dimension less than about 9 inches.

Another object includes the provision of additional panel structure connected with the first panel structure for retaining the coil means between the panel structures. The pipe coil means typically also extends in adjacent relation with the additional panel structure.

A further object concerns the provision of flexible panel structures, and to at least one of which the pipe coil means may be bonded, so as to rigidize same.

A further object includes the provision of additional panel structure forming an opening, and wherein there is flow control means bounded by the coil means, and viewable through the opening. The pipe coil means may include coil stretches that extend in mutually overlying relation, and bonded together as a single unit.

Yet another object includes provision of a combination that includes a purse into which the panel structure and pipe coil means is received.

These and other objects and advantages of the invention, as well as the details of an illustrative embodiment, will be more fully understood from the following specification and drawings, in which:

DRAWING DESCRIPTION

DETAILED DESCRIPTION

In FIGS. 1–4, the portable pressurized gas assembly 20 shown includes a first panel structure as indicated at 10, and a second and thinner panel structure is shown at 11. The latter includes a side wall portion 11*a* extending parallel to 10 in spaced relation thereto, parallel uppermost and lowermost wall extents 11*a* and 11*b*, and parallel left and right extents 11*c* and 11*d*. Wall extents 11*c* and 11*d* merge with 11*a* at conically curved corners 11*e* and 11*f*; and wall extents 11*c* and 11*d* merge with 11*b* at 11*g* and 11*h*. An additional wall 11*i* may be provided adjacent panel 10 as shown, and bonded thereto for support.

Figure 1:
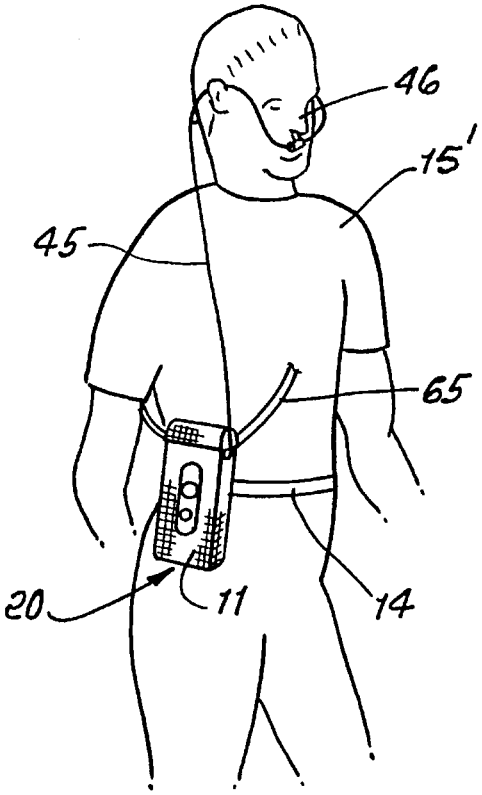
FIG. 1 is a perspective view of the front side of the apparatus of the invention, as carried by a wearer.

Wall 11*i* is peripherally connected to wall extents 11*a*, 11*b*, 11*c*, and 11*d*, to support same. A belt clip may be provided, as at 13, on wall extent 11*i*, to be attached to belt 14 of a human wearer 15, as shown in FIG. 1, whereby ease of removable carriage of the cassette style, size and shape unit 20 is provided for.

Alternatively, the unit may be slipped into a purse 15 that is hand carried by the user. A purse flap is shown at 15*a*.

Panel side wall 11*a* contains a through opening at 16 to provide access to a re-entrant recess or well 17 to contain flow control means or elements, indicated generally at 18, whereby a very compact assembly is provided. Additional looping top and bottom walls 21*a* and 21*b*, and side walls 21*c* and 21*d*, bound the recess and are attached, as at 22, to side wall 11*a*. Elements 18 may include a flow regulator 18*a*, a flow start and stop buttom 18*b*, and a pressure gauge 18*c*.

All such walls typically consist of lightweight material, as for example plastic sheeting, and walls 11*a*–11*i*, and 21*a*–21*d* may be semi-flexible. Portability is thereby enhanced. Also, the device appears to be in the form of a magnetic tape cassette or video cassette, rather than an $O_2$ storage means that includes looping coil structure 25, the latter being confined within the looping interior space 26 formed between side panels 10 and 11*a*, and bounded by panels 11*a*–11*d* and 21*a*–21*d*, as shown and described, whereby the coils are fully concealed and isolated from well 17.

In accordance with an important aspect of the invention, the looping pipe coil means 25 is or are carried by the unit 20 in overlying and adjacent relation to the panel 10. The concealed pipe coil means has closely coiled configuration in a plane or planes parallel to that of the panel 10, for compactness. The looping coil means has pressurized gas inlet and outlet fittings associated therewith, whereby the looping pipe coil means may receive pressurized gas for transport by the human carrier 15, and to provide between ½ and 2 hours demand or use of pressurized oxygen, as at normal human breathing rates.

Figure 4:
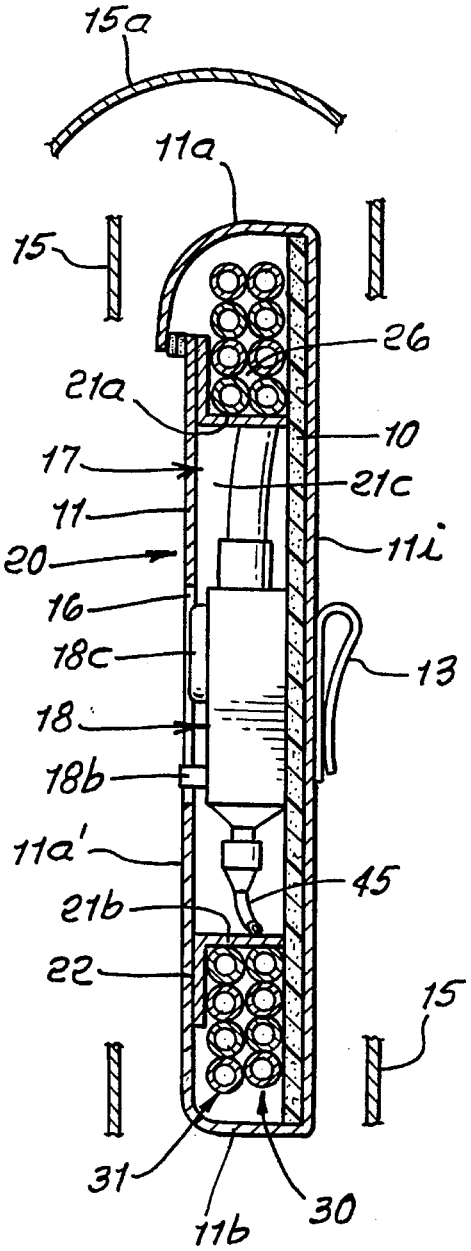
FIG. 4 is a section taken on lines 4—4 of FIG. 2; and also showing concealment in a purse.
Figure 3:
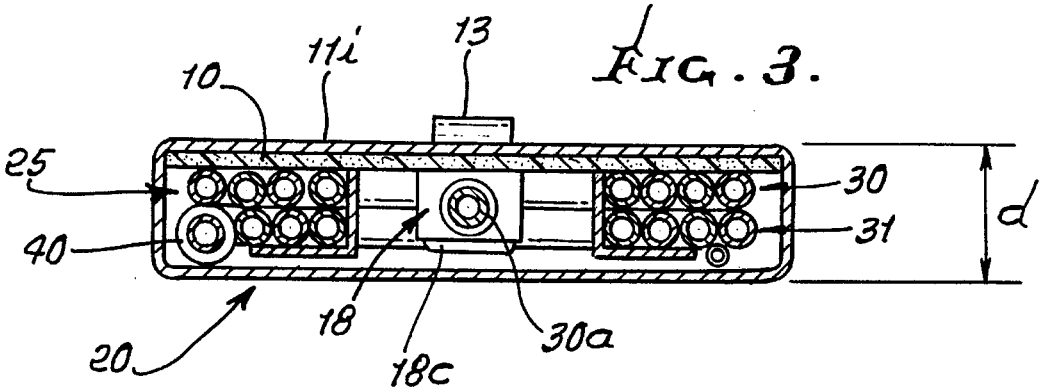
FIG. 3 is a section taken on lines 3—3 of FIG. 2.

In the example, several layers of like pipe coils are provided, as indicated at 30 and 31 in FIGS. 3 and 4, the diameter of the pipe of each coil being substantially less than the receptacle depth dimension "d". Thus, the coils 30 and 31 extend in parallel and stacked relation, to occupy substantial extent of interior 26, except for the relatively central re-entrant recess 17. Pipe coil mounting and positioning structure 34 is located in region 26 and is attached to one of the panels 10 and 21; and such structure advantageously comprises adhesive material 36 that extends within interstices between the coils, as at 36*a* shown in FIG. 5.

Accordingly, the coils are retained in position as a unitized mass, so as not to rattle or deform. Material 36 is shown as bonded to panel 10, to which panel 21 walls are otherwise edge attached. Therefore, a very compact, rugged unit is provided and will not break when dropped.

Each coil or layer 30 and 31 includes spiral turns extending in the same plane, four such turns being provided. The diameter of the coil itself is between 0.25 and 0.50 inches; and the coil is constructed to contain pressurized $O_2$ at between 1,900 and 2,700 psi. The coils 30 and 31 may be connected in series, or in parallel, as respects their $O_2$ intercommunication. An $O_2$ fill fitting appears at 40, connected to end 30*a* of coil 31; and an end of pressure dropping regulator 18*a* in recess 17 is connected to the end 30*a* of coil 30. The opposite end of the regulator has a much smaller diameter hose or line 45 connected to it, as at fitting 45*a*. That line extends to the wearer's nose 46 nostrils, for ingestion of $O_2$, on demand, at ambient air pressure.

A gauge 18*c* on the regulator indicates the supply pressure of $O_2$ remaining in the coils, so that the user may know when to substitute another $O_2$ "cassette" when needed, or to refill the device with $O_2$, as via fitting 40.

Figure 5:
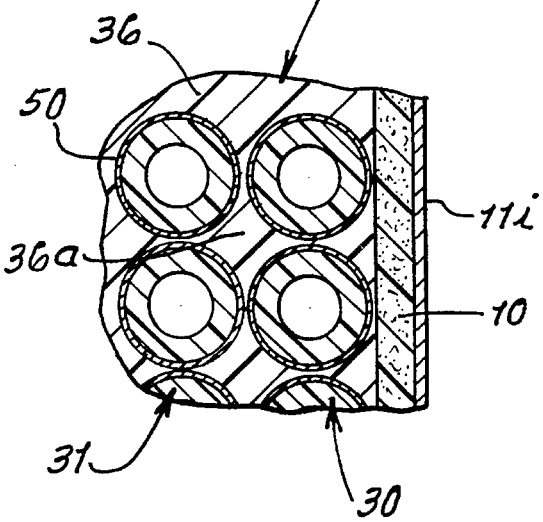
FIG. 5 is an enlarged fragmentary view showing bonding support of coils.
Figure 2:
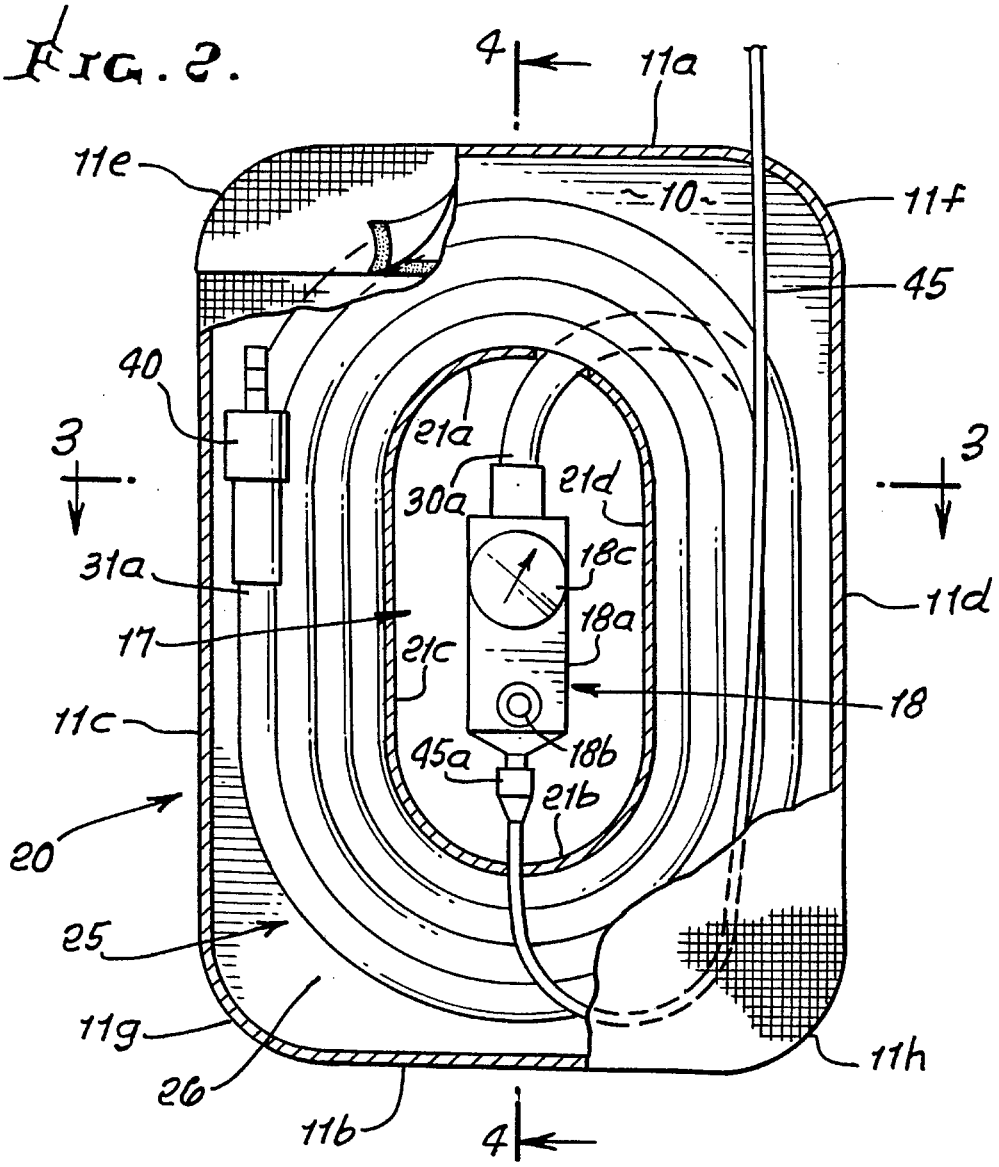
FIG. 2 is a rear view of the FIG. 1 apparatus, partly broken away to show interior construction.

Referring again to FIG. 5, the adhesive material 36*a* is able to expand and contract as the coils themselves expand (during $O_2$ filling) and contract (during $O_2$ use, i.e., outflow). Such yieldably resilient characteristics of adhesive 36*a* may be provided, as by hi-flex Eastman 910 cement, a cyanoacrylate hose material. It readily bonds to thin vinyl coating 50 on KEVLAR coil tubing 30 and 31, as shown in FIG. 5. Coating 50 may be about 0.008 to 0.015 inches in thickness. The yieldably resilient mass of coils and adhesive is thereby retained in position, adhered to plate or panel 10. $O_2$ content of such coils, of about 20 feet in length, supplies about 60 minutes of usage to an average user.

A very compact, rugged, portable, lightweight, non-obtrusive, and conventient (hand-holdable) cassette-type $O_2$ supply device is therefore provided by the device, as disclosed and described herein.

A shoulder strap to carry the device is indicated at 65 in FIG. 1.

I claim:

1. In a portable pressurized gas assembly, the combination comprising a) a first panel structure, b) first looping pipe coil means carried by the first panel structure in overlying relation to said first structure and having flexible construction, there being means rigidly attaching the pipe coil means to the first panel structure at one side thereof, c) said looping coil means having pressurized gas inlet and outlet fittings associated therewith, whereby the looping pipe coil means may receive pressurized gas for transport by a user, d) said first panel structure and pipe coil means having an overall length dimension less than about 12 inches and overall width dimension less than about 9 inches, e) there being additional panel structure connected with said first panel structure for retaining said coil means between said first and additional panel structures, f) said additional panel structure forming an opening, and wherein there is flow control means bounded by said coil means, and viewable through said opening, g) said pipe coil means including coil stretches that extend in mutually overlying relation, and bonded together as a single unit, and by adhesive material that penetrates the interstices formed between the overlying pipe coil stretches to provide therewith a rigidized mass capable of expansion and contraction, with said coils, h) and pressurized $O_2$ in the coil means.

2. The combination of claim 1 wherein said pipe coil means also extends in adjacent and overlying relation with said additional panel structure.

3. The combination of claim 2 wherein said first and additional panel structures are flexible, and said pipe coil means is bonded to at least one of the panel structures so as to rigidize same.

4. The combination of claim 1 wherein said coil means contains sufficient pressurized $O_2$ to provide in excess of 30 minutes $O_2$ supply to a user, at normal breathing rates.

5. The combination of claim 1 including a purse into which said panel structure and pipe coil means is received.

6. The combination of claim 1 including a purse into which said panel structure and said pipe coil means is received.

7. The combination of claim 1 wherein said assembly is in the form of a small case, and including a shoulder strap connected to said case, and an $O_2$ line extending from the case to the nose of a human carrier.

8. The combination of claim 1 wherein said adhesive material attaches the coil means to the first and additional panel structure structures.

9. The combination of claim 1 wherein said coil means consists of KEVLAR, and said adhesive material consists of cyanoacrylate, adapting to expansion and contraction of the coil means as $O_2$ pressure therein rises and falls.

* * * * *